US006341631B1

(12) United States Patent
Hobbs

(10) Patent No.: US 6,341,631 B1
(45) **Date of Patent: *Jan. 29, 2002**

(54) FUNNEL WITH ON/OFF VALVE

(75) Inventor: Rick Anthony Hobbs, Sterling Heights, MI (US)

(73) Assignee: Richard B. Platt, Roseville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/358,563

(22) Filed: Jul. 20, 1999

Related U.S. Application Data

(63) Continuation-in-part of application No. 08/997,577, filed on Dec. 23, 1997, now Pat. No. 5,950,697.

(51) Int. Cl.[7] ..... B67C 11/00
(52) U.S. Cl. ..... 141/344; 141/335
(58) Field of Search ..... 141/331–345, 141/199–205, 297–300, 291, 292, 351–354; 222/501

(56) References Cited

U.S. PATENT DOCUMENTS

| | | | | | |
|---|---|---|---|---|---|
| 228,132 | A | * | 5/1880 | Smith et al. | 222/501 |
| 241,561 | A | * | 5/1881 | Parker | 222/501 |
| 285,168 | A | | 9/1883 | Schussler | 141/335 |
| 493,994 | A | | 3/1893 | Gaudron | |
| 647,111 | A | | 4/1900 | Paradis | |
| 690,576 | A | | 1/1902 | Hesse | |
| 757,170 | A | * | 4/1904 | Young et al. | 222/501 |
| 843,429 | A | * | 2/1907 | Babin et al. | 222/501 |
| 886,237 | A | | 4/1908 | Murtha | 141/335 |
| 943,400 | A | * | 12/1909 | Edmunds | 141/204 |
| 1,094,098 | A | | 4/1914 | Rakottyay | 141/335 |
| 1,104,354 | A | * | 7/1914 | Gentle | 141/335 |
| 1,113,648 | A | | 10/1914 | Karlson | |
| 1,167,580 | A | | 1/1916 | Mackenzie | |
| 1,272,477 | A | * | 7/1918 | Lowrimore | 141/204 |
| 1,293,575 | A | | 2/1919 | Tapman | |
| 1,425,100 | A | | 8/1922 | Jones | |
| 1,549,268 | A | * | 8/1925 | Kerekes | 141/344 |
| 1,631,194 | A | * | 6/1927 | Fahrney | 141/344 |
| 1,815,348 | A | * | 7/1931 | Cox | 222/501 |
| 1,903,139 | A | * | 3/1933 | Trompeter | 141/352 |
| 1,992,187 | A | | 2/1935 | Carvalho | |
| 2,130,876 | A | | 9/1938 | Cordts | |
| 2,193,508 | A | | 3/1940 | Cordts | |
| 2,715,488 | A | | 8/1955 | Conlon | |

(List continued on next page.)

FOREIGN PATENT DOCUMENTS

| | | | |
|---|---|---|---|
| FR | 411333 | 6/1910 | 141/335 |
| FR | 564975 | 1/1924 | |
| GB | 267944 | 8/1927 | 141/335 |

*Primary Examiner*—J. Casimer Jacyna
(74) *Attorney, Agent, or Firm*—Curtis L. Harrington

(57) ABSTRACT

An on/off valve for a funnel having a tapered funnel outlet tube which has a substantially circular cross-section and which has a larger diameter inlet end and a smaller diameter outlet end, and features a substantially spherical occluding element in the tapered outlet tube. The diameter of the occluding element is such that the occluding element rests against the inner wall of the tapered outlet tube to close the funnel outlet tube to prevent passage of liquid therethrough and to permit the sealing at a variety of angular displacements of the spherical occluding element. The occluding element's position in the tapered outlet tube is determined by a wire-like element protruding from the occluding element out of the outlet tube's outlet end, and the protruding element extends substantially parallel to the outlet tube's axis and then bends to form a transverse arm which contacts a rim of a vessel being filled by the funnel to start flow therefrom. A method of making the funnel assembly enables attachment of the occluding element to the actuator rod before introducing the occluding element/actuator rod assembly into the funnel body.

14 Claims, 3 Drawing Sheets

U.S. PATENT DOCUMENTS 2,745,111 A * 5/1956 Podmorski ..... 141/297
3,123,106 A 3/1964 Parhaneim
3,176,728 A 4/1965 Bauman
3,630,083 A 12/1971 Gorans
3,763,903 A 10/1973 Ouchterlony
4,202,386 A 5/1980 Orr
4,598,743 A 7/1986 Milling
4,712,595 A 12/1987 Wilson
4,796,480 A 1/1989 Lahde
4,804,026 A 2/1989 Bailey
4,901,776 A 2/1990 Attinello
5,253,842 A 10/1993 Huebscher et al.
5,269,354 A * 12/1993 Koberg ..... 141/344
5,277,233 A 1/1994 Fleming
5,289,854 A 3/1994 Baker et al.
5,289,855 A 3/1994 Baker et al.
5,322,097 A * 6/1994 Wright ..... 141/199
5,431,205 A 7/1995 Gebhard
5,458,168 A 10/1995 Lindgren
5,515,892 A 5/1996 Najafi et al.

* cited by examiner

FUNNEL WITH ON/OFF VALVE

This is a continuation-in-part of U.S. patent application Ser. No. 08/997,577 filed Dec. 23, 1997, now U.S. Pat. No. 5,950,697.

BACKGROUND OF THE INVENTION

The present invention relates to a funnel having an on/off valve or switch. The funnel is of the type having a large upper liquid holding reservoir portion at a funnel inlet and a tapered outlet or discharge tube extending from a base of the reservoir portion and tapering to a funnel outlet.

Many prior approaches to providing funnels with shut off elements have been proposed. However, all known prior approaches are somewhat complex and expensive to manufacture, given that they require the valve or occluding element to have substantial weight or spring pressure to assure a complete seal against a hard-to-manufacture distinct valve seat formed in the inner walls of the funnel device.

One such known funnel is disclosed in U.S. Pat. No. 1,094,098 and features a valve 22 which is raised by wires 23 and 26. A hook portion 28 of wire 26 is brought into engagement with the wall of a container opening to open the valve allowing fluid held in the funnel to pass through the outlet end of a funnel spout into the container. The valve or occluding element 22 of the '098 patent is mounted in the reservoir portion and its sloping sidewalls must match substantially exactly with the tapered walls of the funnel's reservoir in order to provide an adequate liquid-tight seal. A further disadvantage of approaches such as disclosed in the '098 patent is that the liquid in the entire outlet spout of the funnel will drain therefrom even after the occluding valve closes, thereby maximizing spillage of excess fluid when one desires to cease the exit of fluid from the funnel outlet.

Therefore, there is seen to be a need for a simplified occluding element which does not require a separately constructed valve seat to preclude outflow of fluid from the funnel's outlet end while minimizing escape of excess fluid from the funnel spout once the valve or occluding element has been positioned to halt liquid flow from the funnel.

Another problem with conventional blocking elements in funnel apparatus is the necessity to provide a variety of different type structures for connecting the blocking element to an actuator. Where the actuator and blocking structure combination is not limited in its motion, the blocking element can fall out of the funnel, become jammed, or even lost when the funnel is not in use. Where limited motion is achieved, the connectivity of the blocking element and actuator can be cumbersome and assembly can be difficult. For example, where a blocking plate has to be joined to an actuator structure where the blocking plate and actuator are configured for limited motion, the blocking plate and actuator must be assembled into the funnel area when the connection is to be made. For each connection configuration, there is a tight assembly area, where the funnel provides a restriction. This complicates assembly and drives up the cost of manufacturing the complete funnel, blocking structure and actuator mechanism. This in turn limits the structures and methods of formation and manufacture for the component parts of the completed assembly.

As a result, what is needed is a funnel assembly which can be constructed simply and inexpensively. The method of manufacture and formation of the component parts should enable an inexpensive, stable, and high quality product to be produced.

SUMMARY OF THE INVENTION

To meet the above described need, a funnel having a tapered discharge tube of substantially circular cross-section tapering from a tube inlet to a funnel outlet includes a substantially spherical occluding element for placement in the discharge tube, the occluding element having a diameter greater than a diameter of the funnel outlet and less than a diameter of the discharge tube inlet.

In another aspect of the invention, a funnel having a tapered discharge tube of substantially circular cross-section tapers from a tube inlet to a funnel outlet and is equipped with an on/off valve comprising a substantially spherical occluding element for placement in the discharge tube and having a diameter greater than a diameter of the funnel outlet and less than a diameter of the discharge tube inlet. The on/off valve further comprises an occluding element actuator having a first member coupled to the occluding element and extending beyond the funnel outlet when the occluding element is seated in the discharge tube, and a second member coupled to an end of the first member remote from the occluding element and extending toward the discharge tube inlet exteriorly of the discharge tube, and a third member coupled to an end of the second member remote from the first member and extending transversely away from a longitudinal axis of the discharge tube.

The preferred embodiment provides for a final tapered section in the discharge tube to operate as a valve seat and having an angle of about ten degrees from the centerline. The section of funnel above the final taper can have any angle or height but may preferably have an angle of about 25 degrees from the centerline. The higher the height of the main section, the more fluid pressure will brought down upon the valve seat. Consequently, the pressure necessary to operate the spherical element from below will increase.

The use of a tapered section having a circular cross section as a valve seat, in combination with a flow termination occluding element having a spherical surface, provides a system having a stable tangential sealing line despite significant angular displacement of the occluding element and its actuation member. The use of a spherical element in combination with a taper acts to eliminate the possibility of significant surface area contact which could produce jamming. The use of a spherical occluding element in combination with a taper enables a uniform sealing force to be applied between the spherical occluding element and the outlet tube substantially without regard to the angle between the actuator and the longitudinal axis of the discharge tube. Where the taper is about ten degrees, for example, the downward force on the occluding element is translated into multiplier of about 5–6 against the side of the funnel taper. Further, where the material from which at least one of the funnel and the occluding element is made is elastomeric, a single or a mutual accommodation is formed in the material which compensates for non-ideal shapes of the elements. Where the sealing element is not 100% spherical, the taper of the funnel and the force exerted can compensate for it. Similarly where the shape of the taper within the funnel is not 100% round, the force exerted by the occluding element can cause it to compensate.

Another important aspect of the invention is the manner of making it with regard to its simplicity. Other designs have included the necessity of forming a blocking element with a complex manner of attachment to the actuation apparatus. The occluding element of the funnel system of the invention is formable onto the actuation structure outside of its introduction to the tapering section of the funnel. As a result, it can be formed using a multi-piece mold in a configuration in which the funnel main structure is not present to block the action. The actuator may begin as a straight piece of wire, metal, rod, or plastic. In some cases the actuator may start as a pre-formed shape which can be folded to fit through the funnel outlet. Where the actuator is formable, it is dropped through the funnel outlet until the occluding element engages a seat matching a line slightly lower than its median spherical surface, the actuator is formed by bending to an extent sufficient to not allow the actuator and occluding element combination to pass back through the funnel. This keeps the occluding element from becoming lost, and since the occluding element of the invention can tolerate significant pivotal displacement, the structure which exists beneath the funnel outlet need not be concentric with respect to the actuator.

BRIEF DESCRIPTION OF THE DRAWINGS

Objects and features of the invention will become apparent from a reading of a detailed description of the invention in conjunction with the drawings, in which.

DETAILED DESCRIPTION

Figure 1:
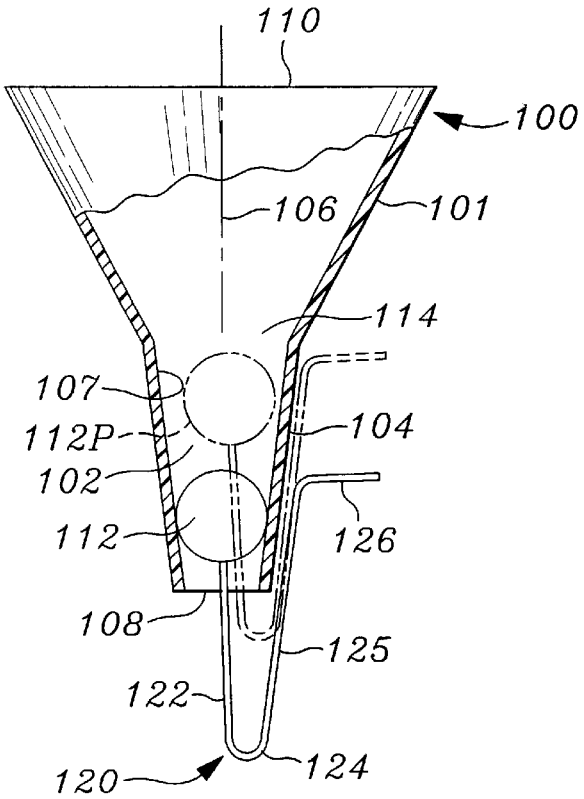
FIG. 1 is a cross-sectional view of a funnel equipped with an on/off switch or occluding element and actuator arranged in accordance with the principles of the invention.

A detailed description of the embodiments of the invention is best begun with reference to FIG. 1. A funnel 100 has an opening at its inlet end 110, a reservoir portion 101 which, in the usual case, tapers downwardly to an inlet end 114 of an outlet tube or spout 102 the wall 104 of which tapers toward funnel outlet 108. The spout wall 104 is therefore seen to converge toward the funnel axis 106 axially along the funnel's outlet spout 102 from the inlet end 114 to the outlet 108.

Within the funnel outlet spout (at least in the off or closed position thereof) is an occluding element 112 which comprises a substantially spherical ball having a diameter slightly greater than the diameter of the inner surface 107 of wall 104 of the cross-section of the wall 104 of the outlet tube or spout 102 at the outlet end 108, but smaller than the diameter of the cross-section of the inner surface 107 of wall 104 of the spout 102 at the spout inlet 114. The diameter of the occluding ball 112 is chosen depending upon where in the outlet spout 102 one wishes the occluding ball 112 to rest when no further liquid is to be discharged from the funnel outlet 108. Naturally, the closer to the outlet end 108 the ball rests in the occluding position, the smaller will be the amount of fluid in the outlet spout 102 which will escape from the funnel 100 once the funnel outlet spout 102 is closed by the occluding element 112.

It should be noted that occluding element 112 need not necessarily comprise a complete spherical ball, but may be truncated, or otherwise be non-spherically shaped at its top or bottom with respect to the funnel outlet spout 102. What is required is that the occluding element have a substantial spherical lateral surface for contact with the converging wall 104 of spout 102.

FIG. 1 shows the occluding element 112 in its closed position in solid lines while an open position of element 112P is shown in phantom dashed lines.

To manually achieve the on or off position of the occluding element 112, an actuator 120 is coupled to the occluding element 112. A first portion 122 of actuator 120 extends outwardly from the funnel outlet 108 in a direction substantially parallel to the longitudinal axis 106 of the outlet spout 102 to a bend 124 whereat the element 120 then has a second portion 125 extending in a reverse direction and terminating in a transversely extending arm or third portion 126.

When the user of funnel 100 desires flow from the funnel outlet 108 to commence, arm 126 is raised toward the funnel inlet end 110 to, in turn, raise occluding element 112 thereby allowing flow of fluid around occluding element 112 and out of the funnel outlet 108. In the usual case, arm 126 would be forced against the rim of an opening in a container into which the fluid is to be transferred. When a user desires flow of fluid out of outlet 108 to cease, then pressure in an upward direction on arm 126 or bend 124 is released and the occluding ball 112 will, under the force of gravity and the substance above it in the funnel, fall to the lower position shown in FIG. 1 to halt flow of fluid out of funnel 100.

The advantage of using a ball-shaped valve inside the angled or tapering funnel outlet spout as described above is that the exact position of the occluding ball is not important. The spherical shape of at least a lateral surface of element 112 may offer advantages of:

1.) creating an effective seal by simply allowing the occluding element to fall to the lowest point possible in outlet spout 102 under the size constraints of the diameter of its lateral spherical surface;

2.) eliminating the need for a separately machined or molded valve seat; and

3.) eliminating the requirement of parallelism between member 122 of actuator 120 and the longitudinal axis of outlet spout 102.

Further adding to the simplicity of the invention is the fact that the element 120, which actuates up motion of the occluding ball 112, need not be perfectly angularly aligned with respect to the axis 106 of the spout 102, since rotation of a ball-shaped occluding valve will not affect the performance of the liquid-tight seal desired.

Actuator 120 can be fabricated from a variety of materials, such as metallic wire or plastic. If the occluding element 112 and actuator 120 are fabricated to form a single unitary construction, then the material used preferably has high flexibility for ease of placement of the occluding element and actuator into the funnel with the actuator extending through the outlet 108. For example, the element 120 could comprise a linear element bent to the final shape shown in FIG. 1 after the occluding ball 112 and attached (or integral) member 120 have been positioned with respect to funnel 100 with element 112 in outlet spout 102 and member 120 extending from element 112 substantially linearly out of funnel outlet 108.

A showing of how the funnel 100 of the present invention is formed is first seen with respect to a wire, rod or stick, referred to as a straight rod 141 from which a multitude of shapes can be made, including the actuator 120 seen in FIG. 1. One end 143 of the rod 141 has a differing shape than the remainder of the rod 141, such as a head 145 slightly expanded in one radial direction by pounding the rod or compressing the end 143 of the rod 141 to provide a slight expansion in at least one radial direction. A roughening 147 of the end of the rod can be formed by rolling with a stone or grinding wheel, or by rolling it in a mill to form a roughened surface having several raised portions which would fix any elastomeric or liquid formed structure formed about the roughened end 147. Both the roughened area 147 and the compressed end 145 are helpful, but other structures can also be employed, and the presence of either of these specific structures is not necessary.

Figure 3:
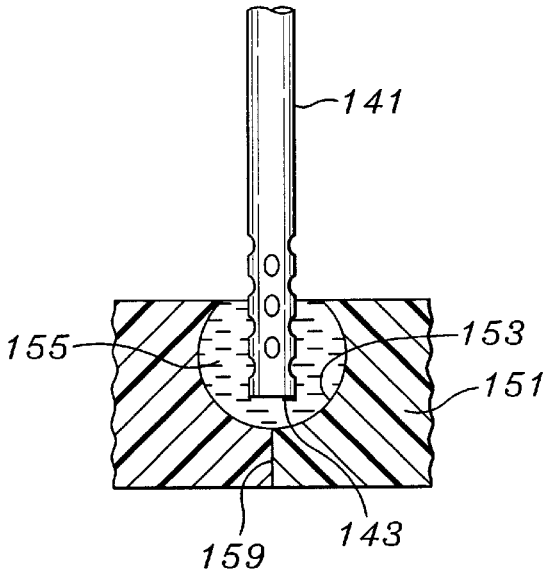
FIG. 3 is a sectional view of a die from which the prepared rod of FIG. 2 protrudes and into which a material is introduced to form an occluding element having a spherical surface.

Referring to FIG. 3, the head 145 of the end 143 of the rod 141 is placed within a mold 151, and specifically within a mold cavity 153. A formable material 155 is introduced into the cavity 153 for adhering to and hardening around end 143, and especially the roughened area 147 and the compressed head 145. The mold 151 has a center separation 159 to enable the mold 151 to be separated to free the formable material 155, which will form an occluding element 112 or 161 having a spherical lateral surface, and which may deviate from sphericity elsewhere on its surface. The occluding element 112 seen in FIG. 1 is shown as being completely spherical. Ideally, enough of the occluding element 161 should be spherical to enable angular pivoting of the occluding element 112 throughout its restricted angular range of motion, while still presenting a spherical surface area to the inside of the tapering wall 104.

This is easily accomplished so long as the actuator 120 diameter is significantly smaller than the funnel outlet 108 and so long as the occluding element 112 is significantly close to the funnel outlet 108. This is important where a non rigid mechanical actuation is to occur, where the actuator, such as actuator 120 seen in FIG. 1 may freely seat at a multiplicity of angles in sealing position, or be manually operated or may be operated by physical contact with surfaces associated with the filling structure.

Figure 2:
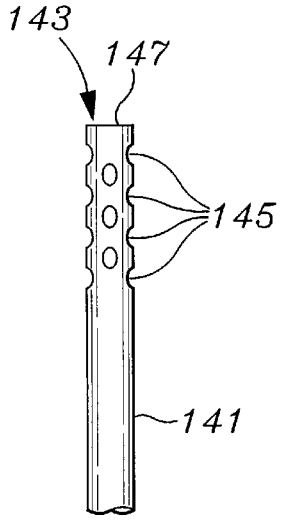
FIG. 2 is an enlarged view of the end of a prepared rod or wire which is slightly flattened and roughened and which may be incorporated as an actuator.
Figure 4:
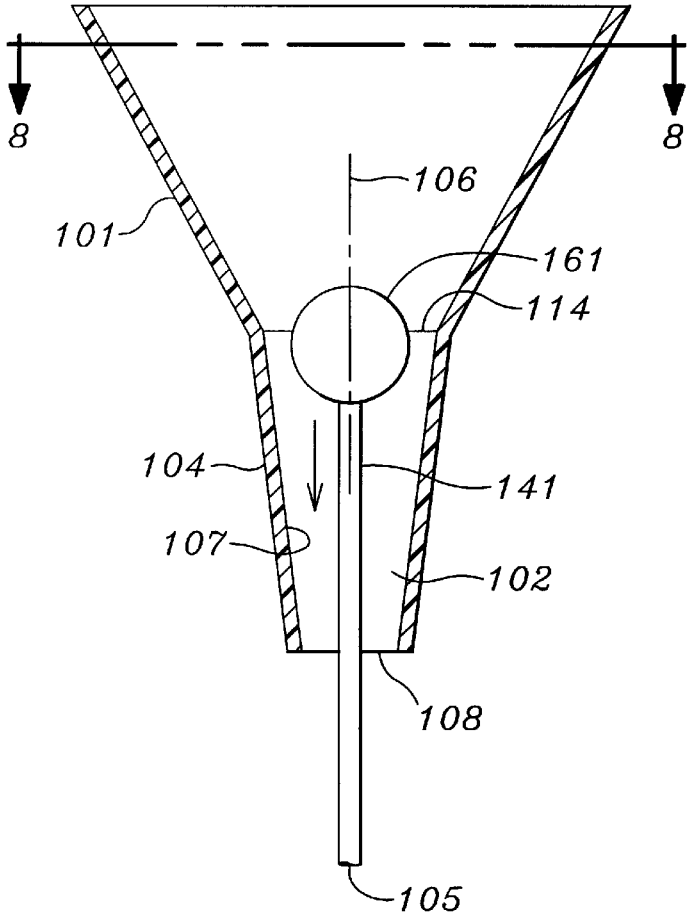
FIG. 4 is a side sectional view of a linear actuator and occluding element being loaded into a funnel shown in longitudinal section before adjustment to limit movement of the actuator and occluding element out of the funnel, available both with respect to a manufactured funnel system of the invention and as a retrofit for use with conventional funnel structures and with the occluding element shown at a level approximating an optimum upward extent of travel such that the area for fluid passage between the occluding element and the nearest side walls are at least greater than the area of the funnel outlet.

Referring to FIG. 4, a next step in the construction of the funnel 100 of the invention is shown. The now hardened formable material 155 forms an occluding element 161 having a substantial portion of its periphery, radial with respect to the length of rod 141 immediately leading into occluding element 161, as spherical. The end 105 of the rod 141 opposite the end 143 (seen in FIG. 2) to which the occluding element 161 is attached is threaded through the reservoir portion 101 of funnel 100, tapering wall 104 and out through the funnel outlet 108. The depiction of FIG. 4 is one in which the leading end 105 of the rod 141 has just passed the outlet 108.

Figure 5:
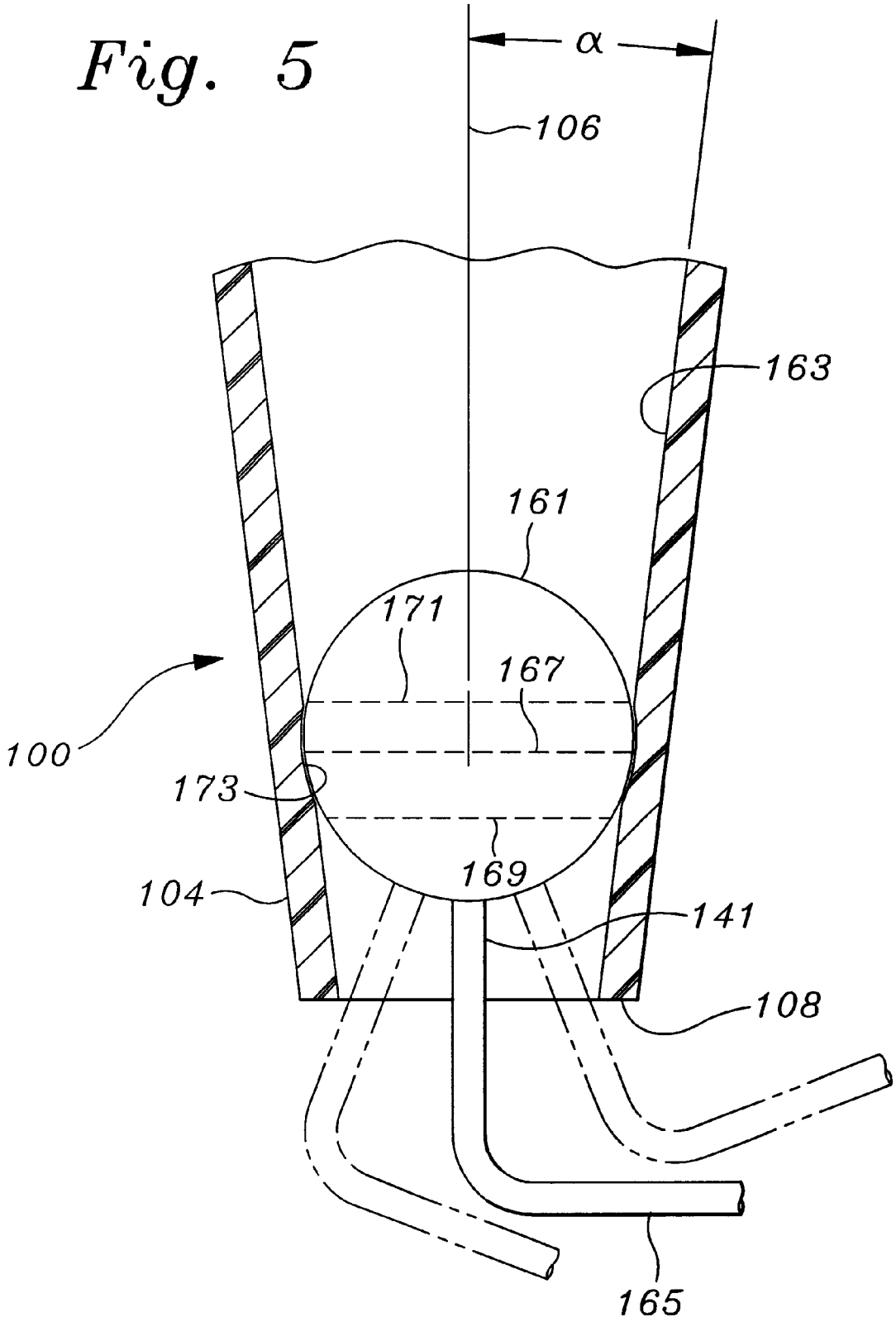
FIG. 5 is an enlarged partial view of the tapered section of the funnel seen in FIG. 4 and illustrating a bend in the actuator to prevent removal from the funnel, as well as the angular displacement which can occur.

Referring to FIG. 5, a closeup view of the occluding element 161 is seen with respect to the wall 104. The occluding element 161 is seen in sealing position against the continuous conical inside surface 163 of wall 104, wall 104 being circular in cross section. The method of forming the funnel 100 thus far has not involved any awkward or dimensionally challenging structures or methods to join the rod 141 to the occluding element because this step was performed before the rod 141 and occluding element 161 assembly were introduced into the funnel 100.

In FIG. 5, a portion of the rod 141 has a bend 165 of extent such that the rod 141 and occluding element 161 assembly cannot be upwardly removed from the funnel 100. The bend 165 is seen as a simple bend but other more complex bends can be formed. The only requirement for the bend 165 and other bends similar to it include: (1) restriction from removing the rod 141 occluding element 161 assembly back out of the funnel, and (2) initial occurrence low enough that sufficient upward movement of the rod 141 occluding element 161 assembly is allowed in order to enable liquid to flow around the occluding element 161 and out through the funnel outlet 108.

The degree of sphericity of the occluding element 161 should be such that the permitted movement of the rod 141 occluding element 161 assembly will not be sufficient to present a non-spherical surface to the continuous conical inside surface 163. So long as this condition holds, the angular position of the rod 141 and occluding element 161 assembly with respect to the longitudinal axis of the outlet tube will not cause the funnel 100 to drip when the occluding element 161 is in its lower position.

The sphericity of the occluding element 161 need not exist over an entire spherical surface of the occluding element 161. As is seen in FIG. 5, a dashed line 167 marks a latitude of the occluding element 161 which is below the general midline of its volume. The position of line 167 will generally depend upon the angularity of the taper of the continuous conical inside surface 163, which is indicated by the angle $\alpha$ and which may be about 10°. Regardless of the angular position of the rod 141 and occluding element 161 assembly, the tapered inner surface of the outlet tube and a spherical surface of the occluding element should contact at all angles to insure a positive fluid cutoff and elimination of leaking drippage.

The funnel 100 of the invention offers great advantages over other systems, including a quick release of flow. Because the sealing line between the occluding element 161 and continuous conical inside surface 163 is slight, there is very little pressure sticking resistance purely due to the interaction between the sealing structures themselves. Compare, for example, a conical occluding element within a conical vessel outlet, movement to enable flow first overcomes the sticking force between the closely adjacent and significant surface area of such an occluding element and its opposing complementary surface. Further, pressure drop is another consideration. The pressure drop maximum occurs at the closest distance between the lifted occluding element 112 or 161 and surface 107 or 163. Compare this to a conical occluding element within a conical vessel outlet and in which the opening provides for a much longer linear flow path between a length of constant separation and progressively smaller cross section of flowing channel. The conical occluding element produces more pressure drop. In sealing, a conical element uses the force of the fluid above to shut off flow, but before flow can be shut off, the liquid is squeezed from between the complementary axially elongate surfaces. Where the liquid is viscous, the draining time and superfluous draining is significant.

Conversely, a flapper arrangement creates significant pressure on a flapper element during high flow. Flow is also not as controllable in a flapper arrangement. As a result, the funnel 100 can be seen to give an optimum degree of advantage with the smooth flow ability and flow controllability not present in either a complementary cone arrangement, nor in a flapper arrangement.

Enabling the rod 141 and occluding element 161 assembly to move freely, including rotation about the longitudinal axis of the rod 141 as well as the angular displacement of the rod 141 and occluding element 161 assembly with respect to the longidudinal axis of the discharge tube as seen in FIG. 5, both combine to produce a polishing effect. By contrast, where an occluding element is rotationally and angularly fixed, the wear on the inside surface 163 would not even out. Wear of the inside surface between an occluding element and the inside surface would be limited to the circular contact line 167. If dirt or debris were to become stuck along this line, further action of the occluding element could abrade the inside surface of the tapered discharge tube at line 167 and abrade the outside of the occluding element 112 which forms the seal, and where the debris becomes somewhat embedded, continue to abrade throughout the useful life of a funnel assembly.

However, the relatively unrestricted angular movement of the rod 141 and occluding element 161 assembly gives greater assurance that debris will not be allowed to collect at a sealing line between the occluding element 161 and continuous conical inside surface 163 since the relative position of these two structures may continually change. Selective movement of these structures helps insure that debris will be dislodged and continue to flow through the assembly of funnel 100 rather than collect. In essence, this action can also be referred to as both self-cleaning and self polishing.

In addition, and assuming a spherical surface or zone of occluding element 161, which is generally shown to exist between a lower limit dashed line 169 and an upper limit dashed line 171 in FIG. 5, the polishing wear which would occur at a line of contact generally indicated by dashed line 167 actually promotes increased sealing over time. To the extent that a manufactured assembly of funnel 101 was somewhat out of tolerance at the beginning of its use, continual use polishes and forms the mating surfaces to a complementary shape. Because the rod 141 and occluding element 161 assembly may be regularly angularly displaced, a general distributed polishing of the occluding element 161 will take place.

On the continuous conical inside surface 163, approximately opposite the line 167 shown on the occluding element 161, the sealing line may develop in to a spherically complementary trough 173. This trough is expected to be very slight, but to the extent that it develops, it will be spherical. In addition, since the area of the occluding element 161 which will come into contact with the continuous conical inside surface 163 is more distributed, the wear on the occluding element 161 will be slight. Because of the allowance of angular displacement of the of the rod 141 and occluding element 161 assembly, the assembled funnel 100 should improve in its sealing capability over time, even where the tolerances of manufacture are not as close as would normally be desired.

Figure 6:
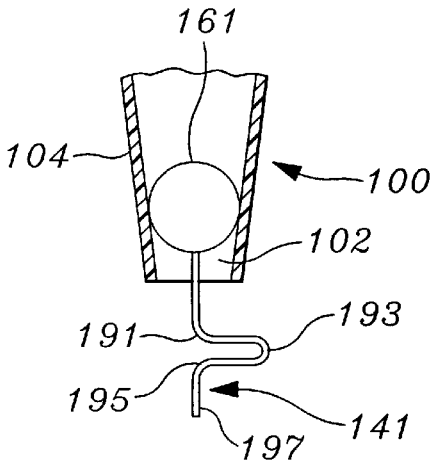
FIG. 6 is a view of a portion of the funnel of the invention similar to FIG. 1 with a "U" shaped kink in the actuator rod to give some sensing distance while at the same time limiting upward movement of the occluding member and actuator combination.

Referring to FIG. 6, the actuator rod 141 of the funnel 100 of the invention has a "U" shaped kink in it, including a right angled bend 191, a "U" shaped bend 193 and a right angled bend 195, and terminates in a downwardly extending straight portion 197, which enables the funnel assembly 100 to give some distance sensing while at the same time limiting upward movement of the occluding member and actuator combination. One of the modes of operation of the funnel 100 assembly is to use a physical touching of some structure on the container to be filled, to actuate the occluding element 161, 112 in the upward direction to enable liquid to flow, followed by a lifting of the funnel 100 assembly to enable gravity and substance still in the funnel 100 to move the occluding element into a shut off position to stop the flow. Where the bottom of the actuator rod 141 is not totally stabilized, as is the case in FIG. 6, the angular pivoting of the occluding element 112, 161 throughout its restricted angular range of motion, will be enabled.

Figure 7:
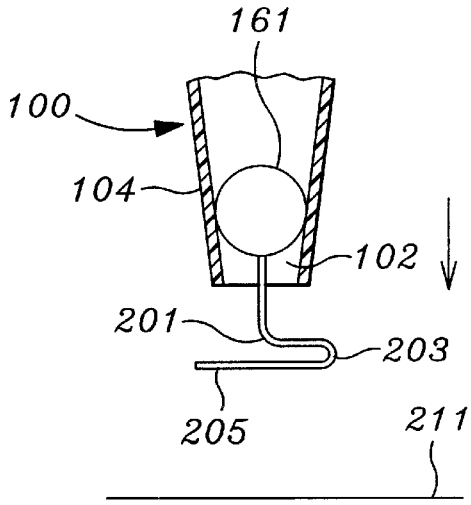
FIG. 7 is a view of a configuration of the funnel of the invention similar to FIG. 6 with a "T" shaped kink in the actuator rod to give a more limiting length probe on actuation while at the same time limiting upward movement of the occluding member and actuator combination.

FIG. 7 is a view of a configuration of the funnel 100 of the invention similar to FIG. 6 with a "T" shaped kink in the actuator rod, including a right angled bend 201, a "U" shaped bend 203, and a laterally extending straight portion 205 which extends back and beyond the lateral position of the right angled bend 201. This provides a flatter bottom surface for actuation and will be more useful in filling structures having a lateral engagement surface. The configuration seen in FIG. 6 is useful for structures having both lateral and bottom engagement surfaces. The downwardly extending straight portion 197 can be long enough to touch the bottom of a container to be filled, where necessary. Likewise, the lateral extent of the bend 203 and length of laterally extending straight portion 205 can be as extensive as needed to match or properly engage structures to be filled. Where an unusual shaped structure is to be filled, the portion of the actuator rod 141 which extends beyond the funnel opening 108 and which enables sufficient clearance for proper actuation of the occluding element 112, 161, can be shaped to engage such specialized structure. It is preferable that the occluding element 112, 161 still be enabled to pivot to accomplish the cleaning and improved sealing over time. Also seen in FIG. 7 is a structure 211 toward which the funnel 100 can be brought until the straight portion 205 makes contact with it. At this point the wall 104 continues downward as the occluding element 161 lifts upward to allow fluid to escape the funnel 100. Although the straight portion 205 would appear to provide angular stabilization to the occluding element 161, keep in mind the displacement of the assembly of the funnel 100 toward and away from the observer of FIG. 7 will create random angular displacements of the occluding element 161, as well as the fact that the spout 102 may be lowered at an angle deviating from the vertical.

Figure 8:
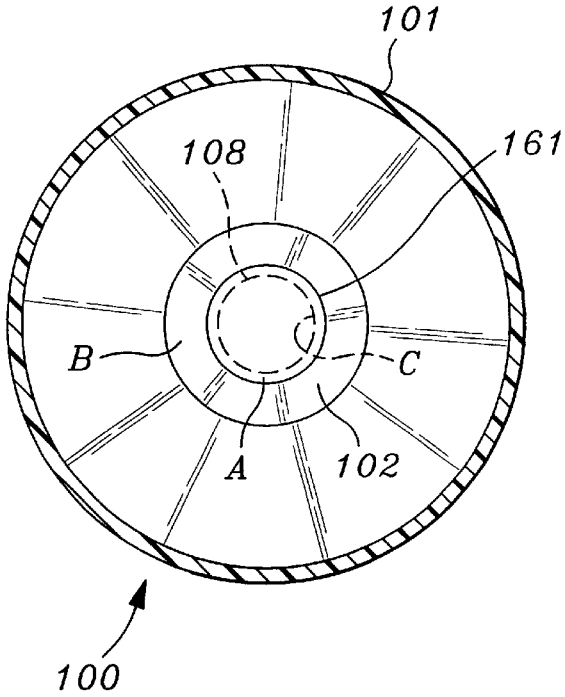
FIG. 8 is a view corresponding to a downward view taken with respect to FIG. 4 and before the bending of the straight rod and which can be used to illustrate the upper limit of travel of the occluding element as providing a flow area between the occluding element and funnel surface equal to or at least as great as the area of the funnel outlet.

FIG. 8, a view looking down into the funnel of FIG. 4 and without illustrating the straight rod 141, illustrates a clear view of the reservoir portion 101, the inside of a continuously tapering outlet spout 102, the occluding element 161, and a dashed line representation of the funnel outlet 108 which is located below the occluding element 161. The straight rod 141 may have a first bend or obstruction limiting the upward movement of the occluding element 161 to a level not higher than that at which maximum flow will occur. In the case of highly viscous liquids, the length of the tapering outlet spout 102 may have a limited effect, but this is not normally the case. In order for funnel 100 to have a zero to maximum flow range, the occluding element must rise high enough to permit an area of flow between the occluding element 161 and the closest funnel surface to be equal to or greater than the area of the funnel outlet 108. In FIG. 8, the letter "A" represents an effective area of the occluding element 161 which has been determined to be slightly below an equatorial line about its spherical surface due to the fact that the outlet spout 102 is tapered. The area "A" may in fact change where the tapering section wall 106 is uneven or where the degree of taper is not linear. The effective maximum area of "A" may vary with respect to the angle of the taper of the outlet spout 102.

The letter "B" represents the effective flow area between the occluding element 161 and the tapering outlet spout 102.

The letter "C" is a static quantity, shown with a dashed line indicator, and is the area of the funnel outlet 108.

In this system of identification "B" represents the area available for flow within the tapered outlet spout 102 at any given height not blocked by the effective equatorial area of the occluding element 161 area "A". It is preferable that the area "B" available at the uppermost extent of travel of the occluding element 161 be equal to or greater than the area "C" so that the maximum flow range of the funnel system of the present invention may be realized. The condition where the area "B" equals area "C" enables flow through said funnel outlet at a rate nearly as if, or nearly the same as would occur said occluding element was absent. The only deviations in the flow rate would relate to the viscosity of the liquid moving past the occluding element 112, 161 and the resulting fluid drag, which is proportional to the viscosity.

Conversely, the area "B" can be adjusted to be less than the area "C" when a low flow rate is desired, such as the addition of one immiscible fluid atop another immiscible fluid where no interaction other than the surface area is desired. Another application would be the handling of liquids when a low flow rate is desired, for example where it is known that the fluid flowing into the vessel being filled requires time to distribute itself in order to provide filling to capacity. In these cases, limitation of the extent of upward movement of the occluding element 112, 161 limits flow in those instances where the reduction of the flow rate is desired.

While the present invention has been described in terms of an occluding element and actuator structure for a funnel to form a funnel assembly which enables pivoting of the occluding element, one skilled in the art will realize that the structure and techniques of the present invention can be applied in many similar applications. The present invention may be applied in any situation where improved seating of an occluding element or valve element over time is combined with a self-cleaning function which inhibits scoring of the component parts thereof and helps insure clean positive closing operation.

Although the invention has been described with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art and the following claims directed thereto.

What is claimed:

1. A controllable funnel assembly comprising:

a funnel having a tapered single discharge tube of substantially circular cross-section tapering from a tube inlet end to a tube outlet end said discharge tube having a longitudinal axis between the inlet end and outlet end substantially longer in length than the diameter of the inlet end;

an occluding element having at least a substantially spherical lateral surface placed in the discharge tube and being operably related to the discharge tube to form a seal with the inside of the discharge tube, the substantially spherical lateral surface of the occluding element having a diameter greater than a diameter of the tube outlet and less than a diameter of the tube inlet;

a single actuator rod having a first end secured to said occluding element and a second end extending through said tube outlet, and wherein said occluding element is constructed of formable material to aid in its attachment to said actuator rod and wherein said occluding element has a resilient outer surface to aid in forming a seal between said occluding element and said inner surface of said tapered discharge tube, and wherein said actuator rod is made of at least one of a stiff bendable material to allow bending of the actuator rod to prevent removal of the occluding element and actuator rod from said tapered discharge tube, and a flexible material having form memory to allow assembly of the occluding element and actuator rod into said tapered discharge tube.

2. The controllable funnel assembly as recited in claim 1, wherein said actuator rod has at least one structure formed in said actuator rod below said tube outlet to limit the movement of said actuator rod in the direction of said tube inlet.

3. The controllable funnel assembly as recited in claim 2, wherein said at least one structure formed in said actuator rod below said tube outlet to limit the movement of said actuator is a bend in said actuator rod sufficient to prevent said actuator rod from passing completely back through said funnel outlet.

4. The controllable funnel assembly as recited in claim 3, wherein said bend in said actuator rod is at least one of a right angled bend, a "U" shaped bend, and a pair of right angled bends separated by a "U" shaped bend.

5. The controllable funnel assembly as recited in claim 2, wherein said at least one structure formed in said actuator rod below said funnel outlet limits the movement of said actuator rod and said occluding element to a height providing a flow area between said occluding element and said discharge tube to at least as great as the area of said tube outlet end to enable flow through said tube outlet at a rate approximating a flow through said tube outlet as if said occluding element was absent.

6. The controllable funnel assembly as recited in claim 2, wherein said at least one structure formed in said actuator rod below said funnel outlet limits the movement of said actuator rod and said occluding element to a height restricting a flow area between said occluding element and said discharge tube to an area at least smaller than the area of said tube outlet to restrict flow through said funnel outlet at a reduced rate.

7. The controllable funnel assembly as recited in claim 1, wherein a lateral dimension of said actuator rod is less than half of a lateral dimension of said funnel outlet for facilitating pivoting of said occluding element.

8. A spherical occluding element for adaptation into an existing funnel structure having a substantially circular tapered discharge tube tapering from a relatively larger inlet end to a relatively smaller outlet end, said funnel structure having a straight axis between the inlet end and the outlet end which is substantially longer than the diameter of the inlet end, comprising:

an actuator rod having a first end and a second end and having at least one of a roughened or expanded area near said first end of said actuator rod to facilitate attachment of said occluding member by molding the occluding member around the first end of the actuator rod; and said spherical occluding element being attached to said first end of said actuator rod said occluding element having a diameter smaller than the diameter of said inlet end of said tapered discharge tube and greater than the outlet end of the discharge tube and the actuator rod to allow the actuator rod to be inserted into the discharge tube inlet end and through the discharge tube outlet end and to allow the occluding element to form a seal with the inside surface of the tapered discharge tube without the occluding element having an ability to pass through the discharge tube outlet end and wherein said actuator rod is of sufficient length to enable said actuator rod to be bent at a point near said discharge tube outlet end to limit the upward movement of the occluding element and still allow said occluding element to achieve a height within said discharge tube sufficient to provide an effective flow area between said occluding element and said tapering spout.

9. A method of controlling flow through a substantially circular tube having an inner surface which tapers from a larger diameter inlet end to a smaller diameter outlet end which tube has a straight axis from the inlet end to the outlet end which axis is substantially longer than the diameter of the inlet end comprising the steps of:

providing an occluding element having at least a lateral spherical surface with a diameter smaller than said inlet end of said tube and larger than the outlet end of said tube for forming a seal between said occluding element and said inner surface of said substantially circular tube due solely to the force of gravity acting on the liquid in the discharge tube and the occluding element; and providing an elongated actuator, operably connected at one end to the occluding element and configured to extend out of the smaller diameter discharge end of said substantially circular tube with the occluding element forming a seal with said inside of said substantially circular tube to provide structure to facilitate breaking said seal between said occluding element and said inside of said substantially circular tube to allow flow through said substantially circular tube.

10. The method of controlling flow through a substantially circular tube as recited in claim 9 and further comprising the steps of:

constructing said occluding element of a formable material to aid in the connection of the occluding element to said actuator and providing the spherical surface of the occluding element with a resilient surface to aid in forming said seal between said occluding element and the inner surface of the substantially circular tube and wherein said actuator is made of at least one of a stiff bendable material to allow bending of the actuator to prevent removal of said occluding element and actuator from said substantially circular tube in which they are placed and a flexible material having form memory to allow assembly of said occluding element and actuator with said substantially circular tube.

11. A controllable funnel assembly comprising:

a funnel having a tapered discharge tube of substantially circular cross-section tapering from the tube inlet end to the tube outlet end, the discharge tube having a straight axis from the tube inlet end to the tube outlet end, and the tube inlet end having a diameter substantially smaller than the axis between the inlet end and outlet end of the discharge tube;

an occluding element having at least a substantially spherical lateral surface placed in the discharge tube, said substantially spherical lateral surface of the occluding element having a diameter greater than the diameter of the tube outlet and less than the diameter of the tube inlet and having a shape capable of forming a liquid-tight seal with an inner wall of the discharge tube as a result solely due to the force of gravity acting upon the occluding element and the liquid in the discharge tube to urge the occluding element toward the funnel outlet to seat at a multiplicity of angular positions of said occluding element; and an actuator rod having a first end secured to said occluding element and a second end extending through said tube outlet.

12. The controllable funnel assembly as recited in claim 11, wherein said actuator rod includes at least one of a right angled bend, a "U" shaped bend, and a pair of right angled bends separated by a "U" shaped bend.

13. The controllable funnel assembly as recited in claim 11, wherein said force is at least one of a gravity force and a force from a fluid within said controllable funnel assembly.

14. A controllable funnel assembly comprising:

a funnel having a tapered discharge tube of substantially circular cross-section tapering from a tube inlet end to a tube outlet end, the discharge tube having a straight axis from the tube inlet end to the tube outlet end and the tube inlet end having a diameter substantially smaller than the discharge tube's axis between the inlet end and the outlet end;

an occluding element having at least a substantially spherical lateral surface placed in the discharge tube, said substantially spherical lateral surface of the occluding element having a diameter greater than the diameter of the tube outlet and less than the diameter of the tube inlet and having a shape capable of forming a liquid tight seal with an inner wall of the discharge tube as a result solely of the force of gravity acting on the occluding element and the liquid in the discharge tube, the diameter of the occluding element also being closer in magnitude to an inner diameter of said tube outlet than to the inner diameter of said tube inlet to enable a wider number of angular displacement sealing positions of said occluding element and to minimize any latent dripping of fluid from within said tapered discharge tube after sealing; and an actuator rod having a first end secured to said occluding element and a second end extending through said tube outlet.

* * * * *